US005083732A

United States Patent [19]

Akamine

[11] Patent Number: 5,083,732

[45] Date of Patent: Jan. 28, 1992

[54] FLEXIBLE BABY BOTTLE HOLDING ANIMAL

[76] Inventor: Horace S. Akamine, P.O. Box 75121, Honolulu, Hi. 96836

[21] Appl. No.: 176,606

[22] Filed: Apr. 1, 1988

Related U.S. Application Data

[62] Division of Ser. No. 84,399, Aug. 12, 1987, abandoned.

[51] Int. Cl.[5] ..... A47D 15/00

[52] U.S. Cl. ..... 248/104; 248/106

[58] Field of Search ..... 248/102-107, 248/161; 446/227, 369, 370, 374

[56] References Cited

U.S. PATENT DOCUMENTS

| | | | |
|---|---|---|---|
| D. 171,644 | 3/1954 | Etienne | 248/103 X |
| 1,662,518 | 3/1928 | Jaffe et al. | 248/104 |
| 2,134,974 | 11/1938 | Hurwitz | 446/374 X |
| 2,202,805 | 5/1940 | Wood | 446/370 X |
| 2,219,130 | 10/1940 | Herrmann | 446/227 X |
| 2,258,076 | 10/1945 | Taylor et al. | 248/104 |
| 3,161,392 | 12/1984 | Kopec et al. | 248/104 |
| 3,325,939 | 6/1967 | Ryan et al. | 446/374 |

FOREIGN PATENT DOCUMENTS

| | | | |
|---|---|---|---|
| 476968 | 9/1951 | Canada | 248/102 |
| 678702 | 1/1964 | Canada | 248/105 |
| 1244459 | 9/1960 | France | 445/370 |

*Primary Examiner*—Alvin C. Chin-Shue
*Attorney, Agent, or Firm*—David Pressman

[57] ABSTRACT

An improved baby bottle holder, specifically for use in feeding and storing the baby's food and to facilitate the easy reach by the baby and for other functions. A single-piece flexible holding device has four major components, namely a multi-use clamp (10), a protective sheath cover (18) which provides protection for safe use, beauty, and is designed to bend with the movements of a flexible rod (20). This flexible rod (20) is adopted from those in common desk lamps. Finally a flexible holding grip (22) that can hold a bottle placed within it by flexibly spreading itself open upon insertion of the bottle and will hold bottles of a variety of widths. The grip has a parallel gap (24) which allows it to adapt to various bottle designs. The device is advantageously built into an animal (28), such as a toy bear, with the grip and clamp in place of the bear's hands.

9 Claims, 4 Drawing Sheets

FLEXIBLE BABY BOTTLE HOLDING ANIMAL

CROSS-REFERENCE TO RELATED APPLICATION

This is a division of application U.S. Pat. No. 084,399, filed 1987-8-12, now abandoned.

BACKGROUND

1. Field Of Invention

This invention relates to a flexible holding device, specifically to an improved baby bottle holder for the use in feeding a baby or storing the baby's beverages.

2. Prior Art

Many, if not most, parents or others who care for babies prefer to use a convenient, safe, simple-to-use, and effective bottle holder to feed the baby and thereby eliminate the necessity for them to attend personally to this duty. In like manner the bottle holder must conveniently satisfy the baby.

Heretofore a wide range of such bottle holders have been proposed and implemented.

One such holder, shown in patent 1,987,132 to Shine (1935), had limited use since its clamp and bottle holder could be used only over the rail of a crib. Most users will agree this is too restrictive. Users must be able to secure a baby bottle holder to a variety of other objects for it to be truly convenient. Also Shine's holder had a clamp and metal cable that lacked safety features. A baby could easily be hurt from the hard sharp edges of the clamp plate and a finger could be severely nipped by the exposed flexible cable. Also rust would eventually appear over the metal flexible cable; such rust would tend to cause injury to the baby if swallowed. Further the user had to follow complex directions just to secure the bottle to the holder. Lastly this device was shaped to simulate a mother's breast. Most women would be too self-conscious and embarrassed to be seen with a baby bottle holder that simulated a breast.

Another type of bottle holder, shown in U.S. Pat. No. 2,826,386 to Conrad (1958), comprised a clamp, flexible rod, and bottle holder. As with Shine's device, this holder had no safety features. Also the user had to pass the bottle through straps, a ring, then equalize these straps with a tension spring while trying to balance the bottle in the center of the harness. This required tedious work and was time consuming and frustrating. Users would eventually resent the labor that must be employed and thus would look for something easier. In addition, there was no easy and effective way to clean the straps when they became soiled as they are molded or cemented into the ring and harness. It was not possible to replace any part of the holder, such as a stained or worn out strap or the corrugated spring, when it eventually lost its elasticity; the user had to purchase an entire new unit. Finally the actual construction and manufacturing of such a bottle holder was complex as it used a variety of materials which required expensive tooling and parts. I.e., it made extensive use of metal machined parts, including a ferrule, threaded stud sleeves, metal screws, a metal clamp, a threaded bore, a base cup, a spring and a ring; these made the product more costly to build, especially in today's competitive market. Further, this holder needed periodic oiling and maintenance.

Likewise the bottle holder in U.S. Pat. No. 2,110,037 to De Rosa (1938) employed a similar clamp and flexible rod. As with the previous two designs, it was expensive to build. This bottle holder was the most costly among the four patents so far discussed and had product liability risks. For example, it had an exposed torsional spring that could tear off tender skin from the baby's finger and poke the baby's eye by its operating lugs. Users would find its weight too great and the holder too awkward to use, despite a built-in universal ball joint and adjustable bracket. Most engineers would agree that when a mechanical instrument uses an excessive variety of parts for such a simple purpose, it tends to break down. It will not be an easy repair if its crucially important torisional spring needed to be replaced or the universal ball joint lost its operational ability. Its adjustable bracket would eventually squeak and become an annoyance to the user and the baby.

The nursing bottle holder in U.S. Pat. No. 2,594,545 to Emens (1952) consisted of a clamp, flexible rod, and a bottle holder. The user had to insert the bottle into a bottle holder abutment, then secure the bottle by sliding spring action metal rods that were located within the pair of tubes up the length of the bottle to its nipple. The front end of the metal rods were shaped into a curved yoke which rested firmly around the nipple for holding the bottle. However this type of action would surely wear down the elasticity of the spring action metal rods and its safety device, whether it employed a thin flexible wire or a thin nylon thread. The user would find the use of this holder hampered or restrictive because of the tendency of the safety device to curl and twist itself within its coil springs. The user also had to be aware of the possibility of harm which awaited the baby should its fingers be caught between the yoke and the bottle, or if the baby inserted the metal rods into its mouth. Other forms of injury could result, such as swallowing the corrosive dust which forms when metal oxidizes.

Most users would find it desirable to have an improved bottle holder which would satisfy the important needs in providing a truly convenient, simple-to-use, durable, reliable, and, above all, absolutely safe-to-use bottle holder.

OBJECTS AND ADVANTAGES

Accordingly several objects and advantages are to provide a superior holding device that is simple and easy to use, is light in weight, convenient, and will hold securely bottles of a variety of shapes and sizes without unnecessary noise, free from the use of corrugated strings, straps, bars, operating lugs, and complex directions that one must follow and motions a pair of hands must do to use the devices of the prior art. Other objects are to provide a new and unique bottle holder or flexible holding device which is light and which operates easily.

Further objects and advantages are to provide a bottle holder which includes protection so as to prevent a finger or hand from being pinched, to provide further protection to prevent the baby's mouth from contacting any raw metal rods, thereby protecting further the baby's gentle gums or teeth, to protect the user and the baby if the flexible rod is handled in very hot or cold weather, and to provide a better-appearing design through a wide assortment of shapes and colors. Additionally, the bottle holder has increased safety and reduced product liability risk. It provides a design which will allow the bottle to be directed into various positions, while having sufficient strength to hold and carry a fully-filled bottle.

In addition my invention provides a multi-use clamp that can be attached to a variety of objects, in addition to rectangular objects, that is easier and faster to operate over square, rectangular, oval, polygonal, and similar multi-sided shapes, and that will not injure the baby.

Also I provide a baby bottle holder which includes a flexible holding device built into as a member body part of a toy teddy bear, monkey, puppy, or other entertaining form, which provides the same functions as mentioned above.

Further I provide an alternative flexible holding device, thereby enabling a user to have a selection of a one-piece unit or a device that can be conveniently disassembled into a few parts, whereby all of these parts can easily be assembled for quick and easy use. I provide a universal ball and socket for the flexible holding device so that it has the ability of movement and direction in conjunction with the position of the recipient. I use an elastic material to hold the bottle or the like firmly to the holding device, and provide additional aids, as buttons, hook and loop fasteners, or buckles.

I also provide a holding device as a tool for assisting the handicapped who may have anatomical, physiological, or mental deficiencies which prevent them from holding a cup, telephone, or other items. The device provides the same appearance, functions, and safety features as mentioned above. Further my holding device also provides a serviceperson, such as an auto mechanic, with means to secure a flashlight and direct needed light to an area where this person is working.

I also provide a bottle holder which can be used without any flexible holding device.

Additional objects and advantages will become apparent from a consideration of the ensuing description, taken in conjunction with the accompanying drawings.

DRAWING FIGURES

DRAWING REFERENCE NUMERALS

Figure 1:
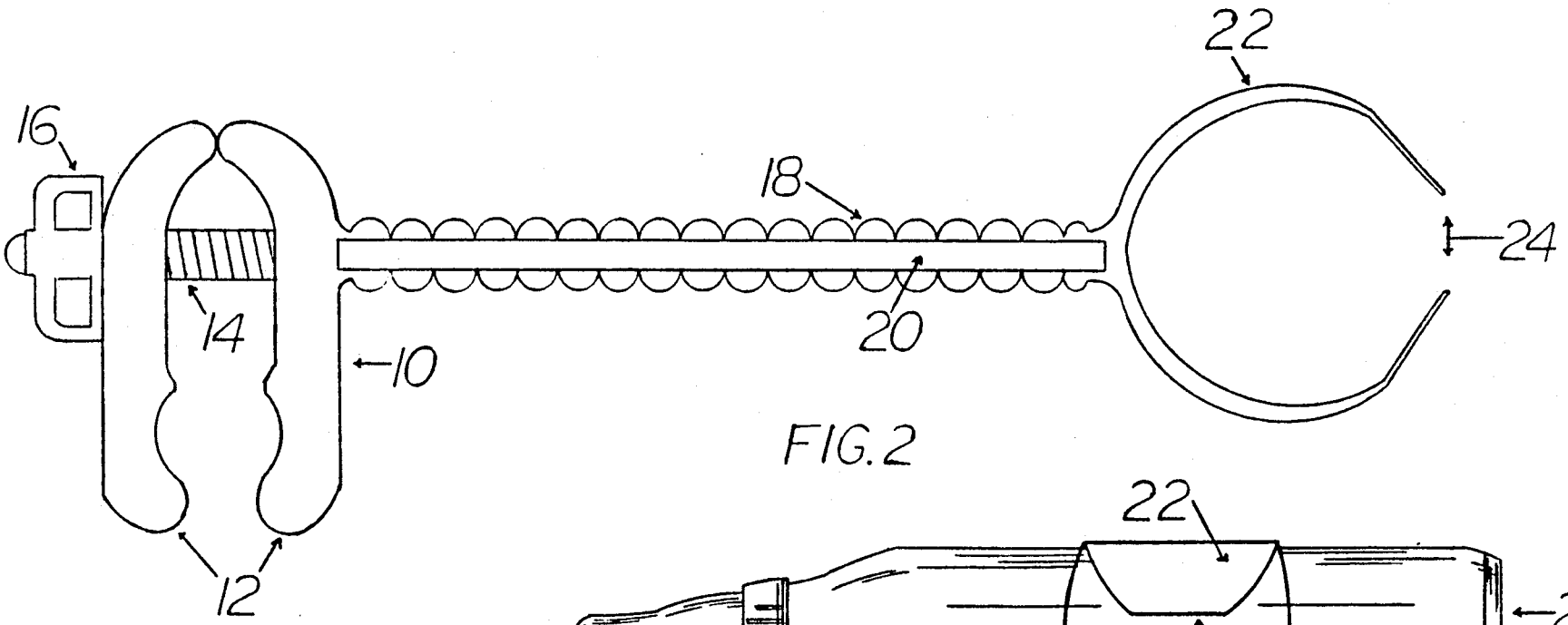
FIG. 1 is a perspective view of a one-piece flexible holding device according to a preferred embodiment of my invention.

10 multi-use clamp
12 grips of clamp
14 threaded key arm of clamp
16 clamp key handle of clamp
18 protective sheath cover
20 flexible rod
22 flexible holding grip
24 gap of grip
26 baby bottle
28 toy flexible holding device
30 platform holding device
32 elastic material
34 underlying nylon hook tape
36 overlying nylon loop tape
38 threaded hole
40 threaded tip

SINGLE-PIECE FLEXIBLE HOLDING DEVICE-DESCRIPTION-FIGS. 1 AND 2

FIG. 1 shows single piece flexible holding device that has four components according to a preferred embodiment of this invention. Preferably the entire flexible holding device is made of plastic and molded to form a single-piece device.

The flexible holding device comprises of a multi-use clamp 10 which is connected together with a flexible rod 20 and a protective sheath cover 18. In turn rod 20 and its cover 18 are attached to a flexible holding grip 22. These four components preferably are formed as a single piece in an injection mold.

Grip 22 is a unique flexible ringlike cylindrical holder that will hold a baby bottle or the like; preferably grip 22 is made of plastic. Grip 22 will hold baby bottles of diameter ranges from about 1.75 in. to about 2.25 in. Grip 22 normally has a circumference width (vertical dimension of FIG. 2) of about 1.75 in. and a base width of about 1 in. Also grip 22 has two tips or free ends which are rounded at their edges to insure safe use; their width is about 0.75 in. From its base to the top of its two tips, grip 22 measures about 1.75 in.

Figure 2:
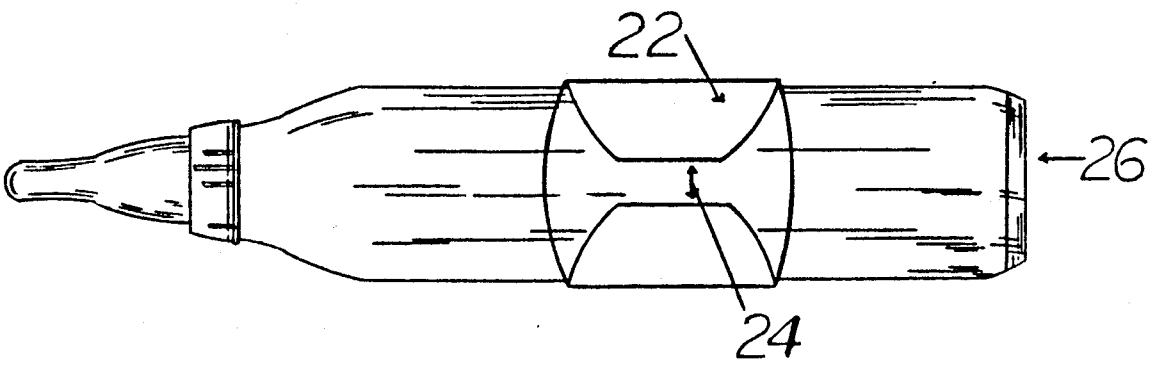
FIG. 2 is an enlarged parallel view of a baby bottle in the flexible holding device.
Figure 3:
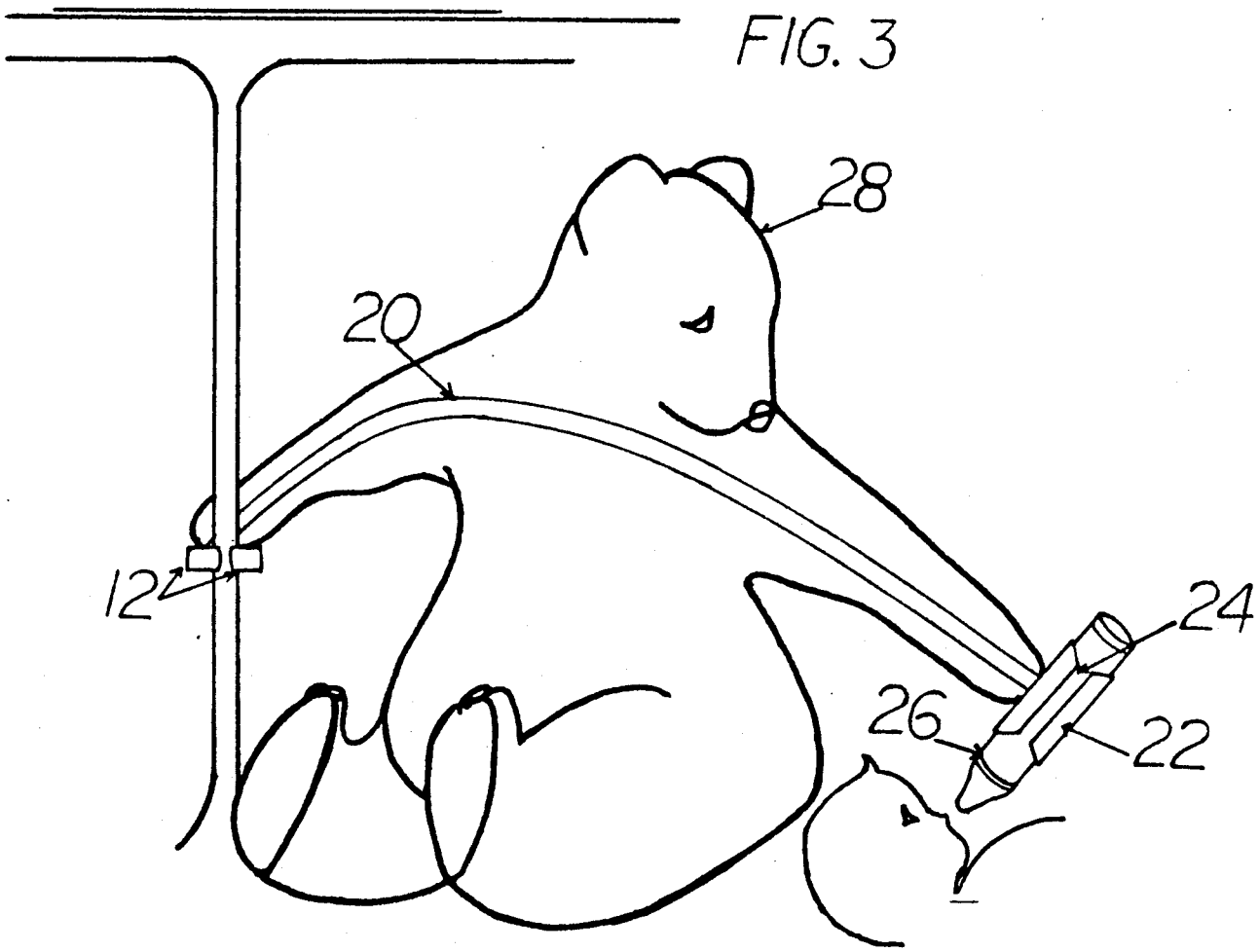
FIG. 3 is a sectional view of a toy animal flexible holding device.

As shown in FIGS. 1 and 2, the width of gap 24 from tip to tip of grip 22 is about 0.25 in. This gap assists in allowing grip 22 to spread wider during the insertion and positioning of a baby bottle. This enables my device to hold a baby bottle successfully without the use of straps, metal rods, flaring spring jaws, or other paraphernalia used in the prior art.

Protective sheath cover 18 and flexible rod 20 are joined to grip 22. Rod 20 is adapted from arms used in common desk lamps in PE pipe form; its width is about 0.5 in. and its length is about 12 in. Cover 18 fits over rod 20 and preferably is designed to have channels or ridges to facilitate bending with rod 20.

Multi-use clamp 10 is joined to cover 18 and rod 20. Clamp 10 includes grips 12 which are about 5.1875 in. long. The insides of grips 12 are arcuate shaped like a half circle with flat edges on both sides of the half circle; the radius of this half circle is about 0.75 in. The width of each of grips 12 is about 0.375 in. For safety, the outer parts of grips 12 have soft and rounded edges. A threaded key arm 14 is part of clamp 10; its length is about 2.5 in. A clamp key handle 16 is located on key arm 14; it is very important to have a large, easy-to-hold and operate handle 16.

I have elected to use only one type of material, preferably plastic on all four major components: grip 22, cover 18, rod 20, and clamp 10. All components are molded as a single piece with soft and rounded edges.

TOY-FIG. 3

The single piece flexible holding device of FIG. 1 will also function in a most unique and novel way by being built as a body part of a toy teddy bear, monkey, puppy, or other toy animal form. The flexible holding device is identical to that of FIG. 1, but is part of the toy animal used, i.e., the holding device is part of the body of the toy. The actual length of rod 20 can be shortened or extended. Clamp 10 may be part of the teddy bear's back paw, rod 20 may run through the body where it forms part of the body's structural support, and grip 22 is part of the outstretched arm, with the paw actually forming grip 22 which holds the baby bottle.

PLATFORM DEVICE WITH ELASTIC MATERIAL—FIG. 4

Figure 4:
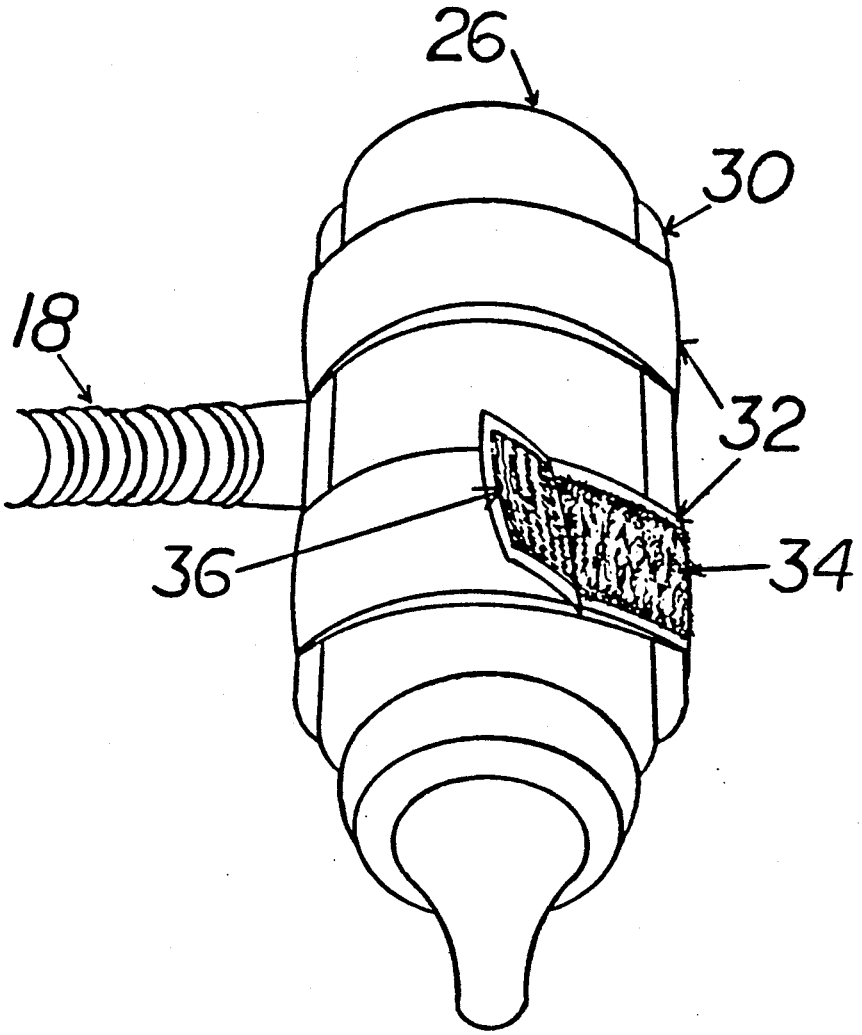
FIG. 4 is an enlarged perspective view of a platform device with elastic material and nylon hook-and-loop tape fasteners.

As shown in FIG. 4, a platform-like holding device 30 is attached to rod 20, cover 18, and clamp 10 as in FIG. 1; the parts used are otherwise identical to those of FIG. 1. An elastic band 32 is used by simultaneously pulling it over two spaced locations on baby bottle 26 and platform 30.

To enhance the convenience and speed of banding the baby bottle and other objects, nylon hook-and-loop tape fasteners can be used; these are sold under the trademarks VELCRO and LATCHLOK. They consist of two tapes attached to the ends of bands 32. An underlying hook fastener 34 side is fuzzy in appearance while the overlying loop fastener 36 is rough and looplike in appearance. When pressed together they will lock and can be separated when pulled apart. The length of elastic material 32 is about 9.5 in. and the length of each of nylon tapes 34 and 36 is about 3 in. The width of elastic material 32 is about 1 in. and that of nylon tapes 34 and 36 is about 0.75 in. The platform's length is about 4 in. and its width is about 2.25 in.

FLEXIBLE HOLDING DEVICE ROD AND BABY BOTTLE: FIG. 5

Figure 5:
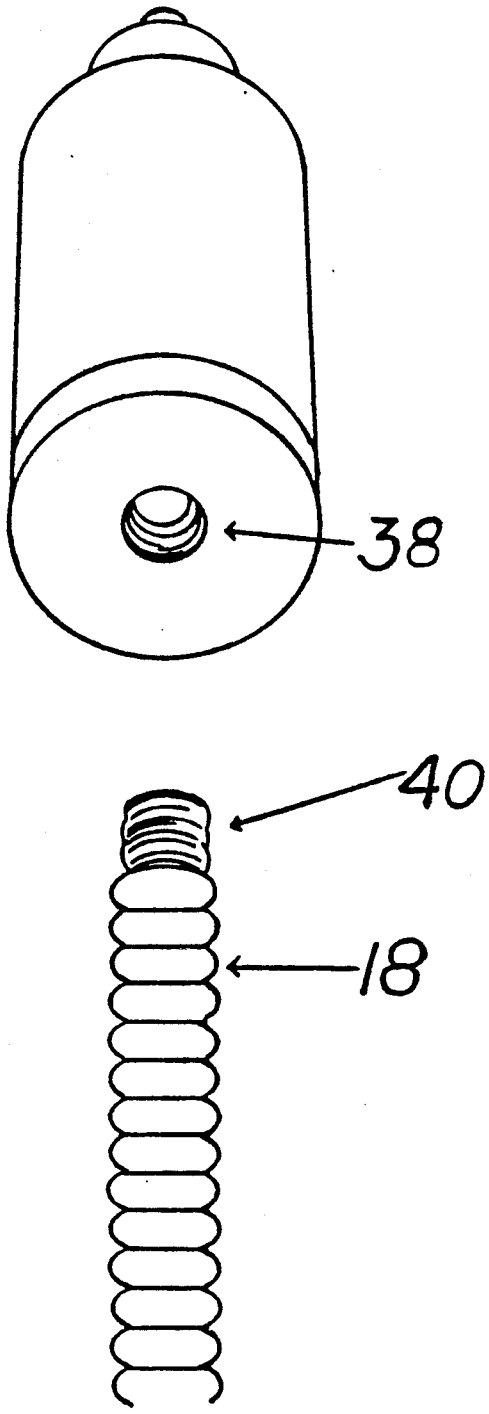
FIG. 5 is a front sectional view of the flexible holding device showing an threaded tip on a rod used in such device and the baby bottle's mating threaded hole.

As shown in FIG. 5, the rod is similar to that of FIG. 1, and is attached to the same protective sheath cover 18 and multi-use clamp 10 of FIG. 1. However in FIG. 5, tip 40 of the rod is made of plastic and has screw threads. These threads are part of the protective sheath cover 18 and can be mated with threads in hole 38 in the center underside of the base. The plastic screw tip is about 0.75 in. and hole 38 is about 0.75 in. deep.

SINGLE-PIECE FLEXIBLE HOLDING DEVICE—OPERATION

The single piece flexible holding device of FIG. 1 will hold baby bottle 26 of FIG. 2. To operate the flexible holding device to feed a baby, the user first must secure clamp 10 onto a convenient furniture arm or the like. Because of their novel shape, arcuate grips 12 10 can be attached around virtually any type of support; the user does this simply by turning handle 16 until it is tight and secure. Then, while holding flexible rod 20, the user may bend and shape rod 20 into the desired position.

To operate grip 22, the user places baby bottle 26 into either end of grip 22. This will spread grip 22 open and simultaneously envelop and grip baby bottle 26 tightly.

CONCLUSION, RAMIFICATIONS, AND SCOPE

Readers will see that this bottle holder provides a flexible holding device which is improved, novel, practical in almost every respect and can be used without fear of injury. It is very easy to operate and use. Since it can be made of plastic, it is light in weight. It is highly reliable because of its single-piece design; it eliminates the use of many parts such as shields, metal screws, springs, straps, etc. In addition it can be washed without fear of rust developing nor any harm to its continued reliable performance.

Although this application contains many specificities, the reader should not construe these as limitations on the scope of the invention, but merely as exemplications of the preferred embodiments thereof. Many other variations are possible. For example, a skilled artisian will readily be able to change the dimensions and shapes of the various embodiments. They will also be able to make the flexible holding device of alternative materials such as metal, fiberglass, plexiglass, graphite, wood, or a combination of polymer materials. They can make variations on grips 12 or multi-use clamp 10. They can make protective sheath cover 18 of a rubbery material. They can make the flexible holding device of discrete components, i.e., multi-use clamp 10, protective sheath cover 18, flexible rod 20, and flexible holding grip 22 can be discrete so that it can be dismantled and assembled at the user's convenience.

Accordingly, the reader is requested to determine the scope of the invention by the appended claims and their legal equivalents, and not by the examples which have been given.

I claim:

1. A device for holding a baby bottle which has a nipple and which is filled with milk or another beverage in position with said nipple in said baby's mouth such that said baby can drink said beverage from said filled bottle without said baby or another person having to hold said bottle in said position, comprising:

an animal figure having a torso and a pair of outstretched arms extending from opposite sides of said torso, animal-figure-attachment means at the end of one of said arms for removably attaching the end of said arm to a fixed member so as to support said animal figure from said fixed member, bottle-holding means at the end of the other of said arms for removably holding said beverage-filled baby bottle at said end of said other arm, said bottle-holding means being strong enough to hold said beverage-filled baby bottle in a fixed position while said baby is drinking the beverage therein, elongated bendable-means within said animal figure for enabling the position of said bottle-holding means to be selectively adjusted to any desired position within a range of positions when said animal-figure-attachment means is attached to said fixed member, one end of said bendable means being attached to said animal-figure-attachment means, said bendable means extending through said one arm, through said torso, and through said other arm, the other end of said bendable means being attached to said bottle-holding means, said bendable means being rigid enough to hold said filled baby bottle in a fixed position at any position within said range of positions when said animal-figure attachment means is attached to said fixed member, said animal-figure-attachment means being sturdy enough, so that when attached to said fixed member, it can hold said animal figure and said beverage-filled baby bottle in a cantilevered manner so that said beverage-filled baby bottle will remain fixed in any position within said range of positions, wherein said device can be used to hold a baby's bottle in any desired position within said range of positions with respect to said fixed member for the unattended feeding of said baby, and whereby said animal figure will communicate physical, psychological, and emotional warmth to comfort said baby when said baby is drinking said beverage.

2. The baby bottle holder of claim 1 wherein said animal figure is a toy bear.

3. The baby bottle holder of claim 2 wherein said bottle-holding means is a one-piece, C-shaped flexible clamp with a pair of free ends which point together and form a gap therebetween.

4. The baby bottle holder of claim 2 wherein said animal-figure-attachment means is an adjustable clamp comprising a pair of generally parallel members with means for causing said members to move together or apart.

5. The baby bottle holder of claim 4 wherein said animal-figure-attachment means is a turnscrew and a threaded rod extending between said members.

6. The baby bottle holder of claim 1 wherein said bottle-holding means is a one-piece, C-shaped flexible clamp with a pair of free ends which point together and form a gap therebetween.

7. The baby bottle holder of claim 1 wherein said animal-figure attachment means ia an adjustable clamp comprising a pair of generally parallel members with means for causing said members to move together or apart.

8. The baby bottle holder of claim 7 wherein said animal-figure-attachment means ia a turnscrew and a threaded rod extending between said members.

9. The baby bottle holder of claim 1 wherein said elongated bendable means is a flexible rod which has a flexible protective sheath cover thereover.

* * * * *

UNITED STATES PATENT AND TRADEMARK OFFICE

CERTIFICATE OF CORRECTION

PATENT NO. : 5,083,732
DATED : January 28, 1992
INVENTOR(S) : H.S. Akamine

It is certified that error appears in the above-indentified patent and that said Letters Patent is hereby corrected as shown below:

Column 1, line 6, delete "U.S. Pat. No.".

Signed and Sealed this

Seventeenth Day of August, 1993

Bruce Lehman

*Attest:*

BRUCE LEHMAN

*Attesting Officer*

*Commissioner of Patents and Trademarks*